US007069927B1

(12) United States Patent
Pan

(10) Patent No.: US 7,069,927 B1
(45) Date of Patent: Jul. 4, 2006

(54) WATERPROOF DEVICE FOR A SNORKEL

(75) Inventor: Chen-Lieh Pan, Yilan Hsien (TW)

(73) Assignee: Water Square Sports Co., Ltd., Taipei Hsien (TW)

( * ) Notice: Subject to any disclaimer, the term of this patent is extended or adjusted under 35 U.S.C. 154(b) by 0 days.

(21) Appl. No.: 11/213,981

(22) Filed: Aug. 30, 2005

(51) Int. Cl.
*B63C 11/16* (2006.01)
*B63C 11/02* (2006.01)

(52) U.S. Cl. ..... 128/201.11; 128/201.27

(58) Field of Classification Search ..... 128/200.29, 128/201.11, 201.26, 201.27, 201.28, 206.29; 405/186, 187; 181/21, 127
See application file for complete search history.

(56) References Cited

U.S. PATENT DOCUMENTS 5,117,817 A * 6/1992 Lin ..... 128/201.11
5,529,057 A * 6/1996 Ferrero et al. ..... 128/201.11
5,960,791 A * 10/1999 Winefordner et al. . 128/201.11
6,679,253 B1 * 1/2004 Feng ..... 128/201.11
6,843,246 B1 * 1/2005 Shiue ..... 128/201.11
2005/0224077 A1 * 10/2005 Kuo ..... 128/201.11

FOREIGN PATENT DOCUMENTS

GB 2163962 * 3/1986

* cited by examiner

*Primary Examiner*—Teena Mitchell
(74) *Attorney, Agent, or Firm*—Rabin & Berdo, P.C.

(57) ABSTRACT

A waterproof device for a snorkel is mounted on a distal end of a breather pipe and has a lower shell, a ring, an upper tube with an open end, an elastic collar, and an upper shell. A lower pipe is mounted to a lower end of the lower shell and the ring is received into the lower pipe. The upper tube is pivotally connected to the ring via the elastic collar securely mounted between the ring and the upper tube. A seal board is mounted in an inner wall of the upper shell thereby achieving a water proof effect when the open end is securely connected to the seal board.

16 Claims, 3 Drawing Sheets

WATERPROOF DEVICE FOR A SNORKEL

BACKGROUND OF THE INVENTION

1. Field of the Invention

The present invention relates to a waterproof device for diving, and more particularly to a waterproof device which is mounted on a distal end of a snorkel.

2. Description of Related Art

Snorkels combined with face-masks in various forms have been used by swimmers for many years, as they permit good vision below the water surface and are relatively simple in construction, cheap and do not require lengthy training for use. When the swimmer's face is immersed in water, a first end of the snorkel formed as a hook is received in the swimmer's mouth and a second end remains above the water surface, whereby air is drawn down the snorkel from the second end and then exhausted from the first end. If the second end is a simply straight, water may easily enter the snorkel whereby the swimmer will at least have to return to the surface, and may even choke. Other snorkels may have a second end that is hooked and a small cage with a loose ball is fitted thereto. The ball, such as the common ping-pong ball is buoyant on the water such that when the swimmer descends further than a height of the snorkel, the ball seals the snorkel tube to keep out water. However, this device also prevents the passage of air so the swimmer must rise to the water surface. Prior to inhaling via any snorkel, a swimmer must first blow out to eject any water that may have entered the snorkel. However, this is found to be rather difficult for most swimmers.

U.S. Pat. No. 5,960,791 discloses a conventional waterproof device for a snorkel, which is mounted on an end of the snorkel, is composed of a tube, a body, a buoyant member and a waterproof cover. The end remains above the water surface and the tube is provided on the end of the snorkel which is inserted into the body in 90 degrees relative to the water surface. The end of the snorkel is covered with a valve which is mounted in the buoyant member thereby preventing the water from entering snorkel. With the density of the valve lower than that of the water, the buoyant member can open to enable the air to enter the snorkel or close to prevent the water automatically.

However, the conventional waterproof device for the snorkel has a complicated configuration with the body, the buoyant member and the waterproof cover provide on the snorkel. Furthermore, the buoyant member is pivotally mounted on a side of the body thereby occupying a large space and it is inconvenient to use with the conventional waterproof device for the snorkel. Additionally, the space between the body and the waterproof cover is divided into two segments, one is for receiving the buoyant member and the other is for the pivotal rotation of the buoyant member. Therefore, the space for receiving the buoyant member is reduced and buoyant member is made by low density material, so the weight of the buoyant member is always not enough. Thus, it is easy for the buoyant member to abut and seal the end of the snorkel with deep breath of the diver thereby scared the diver.

Therefore, the invention provides a waterproof device for a snorkel to mitigate or obviate the aforementioned problems.

SUMMARY OF THE INVENTION

The main objective of the present invention is to provide a waterproof device for a snorkel which is convenient to use due to its small volume.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
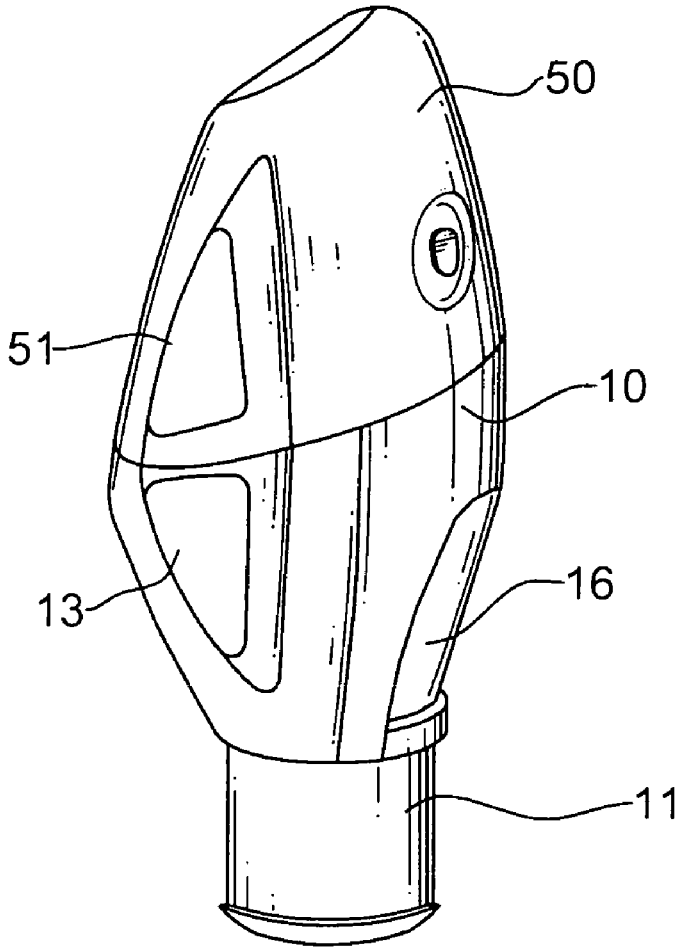
FIG. 1 is a perspective view of a waterproof device for a snorkel in accordance with the present invention.
Figure 2:
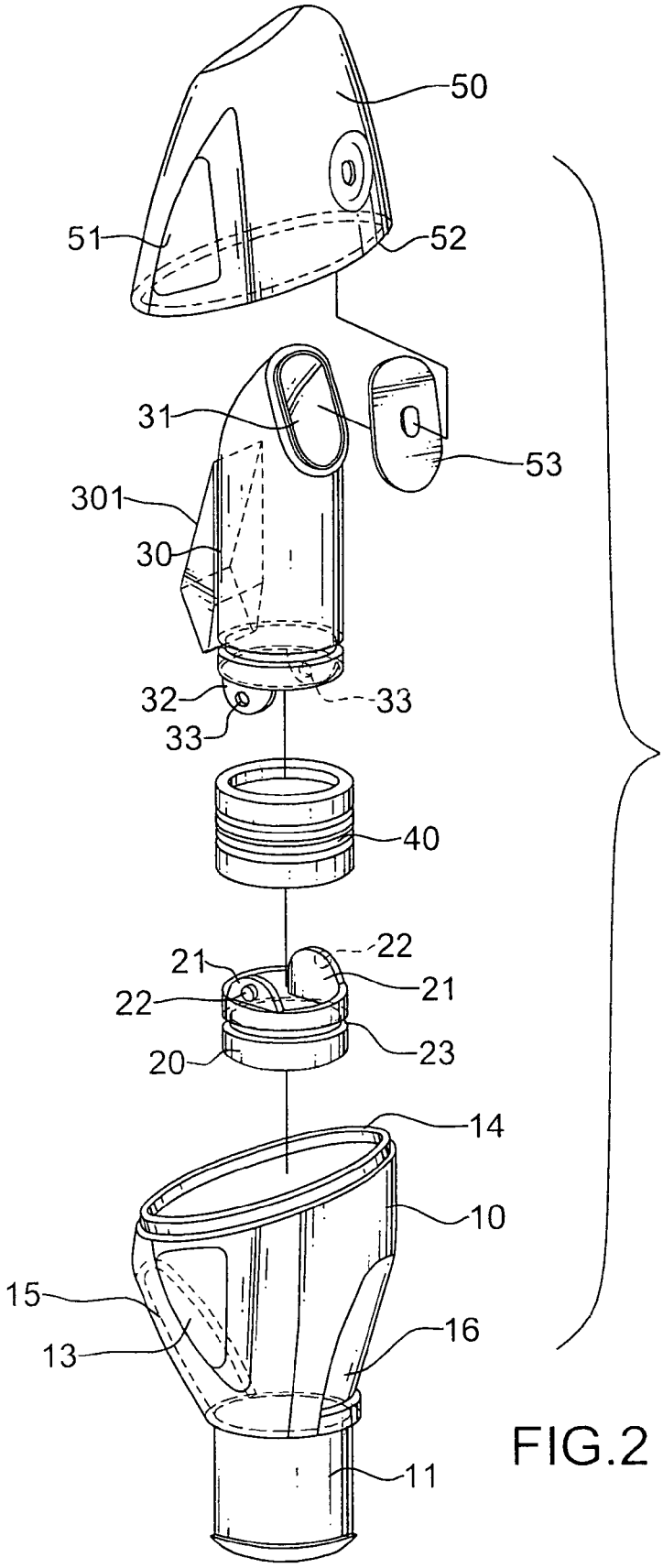
FIG. 2 is an exploded perspective view of the waterproof device for a snorkel in accordance with the present invention.
Figure 3:
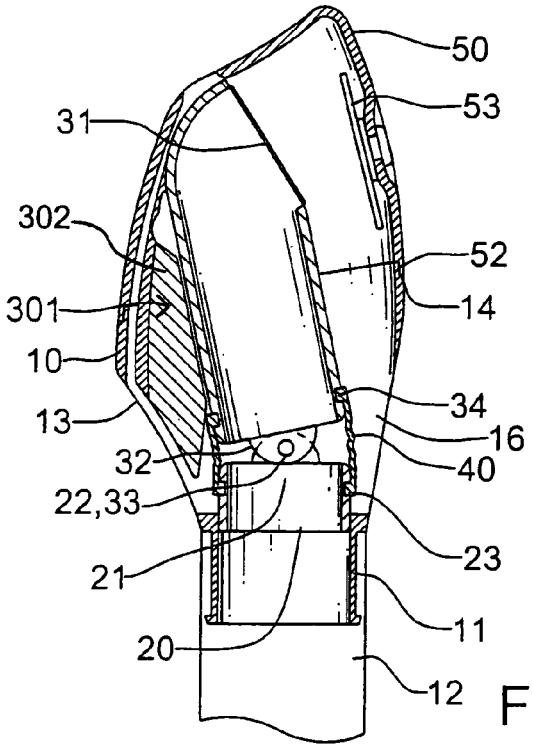
FIG. 3 is a sectional view of the waterproof device for the snorkel in accordance with the present invention.
Figure 4:
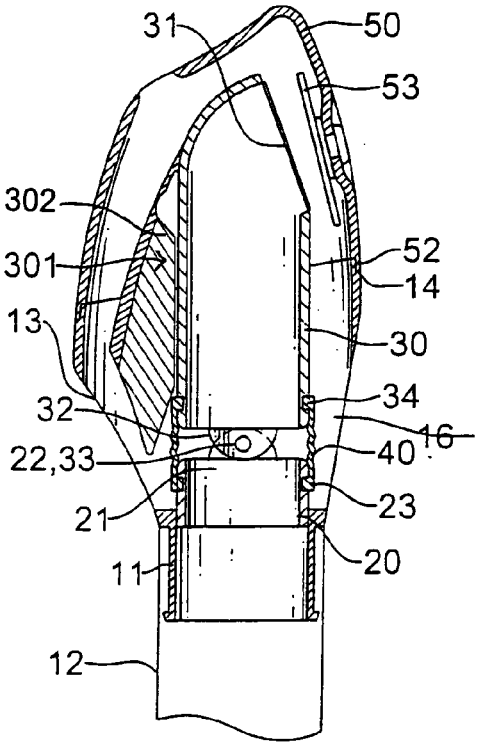
FIG. 4 is a sectional view of the waterproof device for the snorkel in accordance with the present invention in usage.
Figure 5:
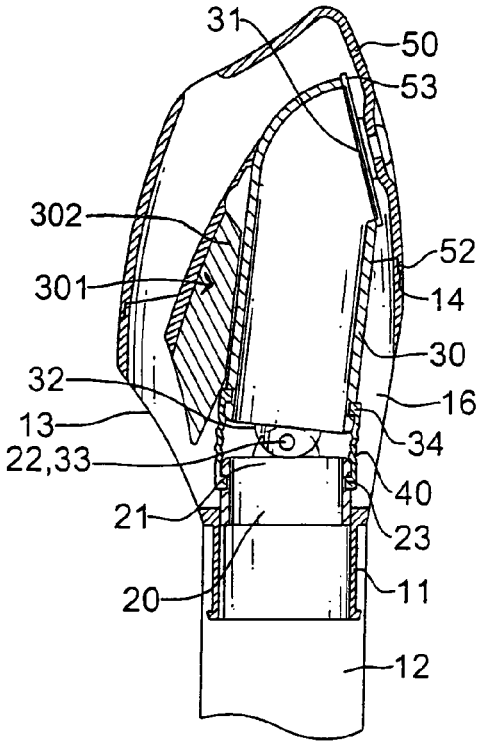
FIG. 5 is a sectional view of the waterproof device for the snorkel in accordance with the present invention in usage.

With reference to FIGS. 1–3, a waterproof device for a snorkel comprises a lower shell (10), a ring (20), an upper tube (30), an elastic collar (40), and an upper shell (50).

The lower shell (10) has a lower pipe (11) provided in a lower end thereof and a first end of a breather pipe (12) is sleeved over the lower pipe (11) and a second end of the breather pipe (12) is received into a swimmer's mouth. A first, a second and a third vents (13, 15, 16) are respectively defined in a periphery of the lower shell (10) and a flange (14) is formed at an upper end of the lower shell (10).

The ring (20) is received into and securely mounted with the lower pipe (11). Two first ears (21) are respectively formed on two opposed top ends of the ring (20) and two lugs (22) are respectively formed on the ears (21). A first circular groove (23) is defined in a middle portion of an exterior of the ring (20).

An inclined open end (31) is defined in a top end of the upper tube (30) and two second ears (32) are respectively formed on a bottom end of the upper tube (30) and mated with the first ears (21). Two holes (33) are respectively defined in the second ears (32) and the lugs (22) are respectively inserted into the holes (33) so that the upper tube (30) can pivot relative to the ring (20). A second circular groove (34) is defined in an outer periphery of the upper tube (30) and a chamber (301) is formed in a side of an outer wall of the upper tube (30). A sponge (302), shown in cross-section, with low specific density is received into the chamber (301) or the chamber (301) is filled with air, to increase the floatation of the upper tube (30).

An upper end of the elastic collar (40) is mounted around the second circular groove (34) and a lower end of the elastic collar (40) is mounted around the first circular groove (23) so that the elastic collar (40) is connected to the ring (20) and the upper tube (30) to prevent the water from entering a joint of the ring (20) and the upper tube (30). The elastic collar (40) has concertina-like configuration so that it can remain attached to the upper tube (30) when the upper tube (30) pivots relative to the lugs (22).

An orifice (51) is defined in the upper shell (50). A rim (52) is formed in a lower end of the upper shell (50) and corresponds to the flange (14) so that the upper shell (50) is connected to the lower shell (10) via the rim (52) being mated with the flange (14). A substantially oval seal board (53) is mounted on an inner wall of the upper shell (50) and is configured to mate with the open end (31).

With reference to FIG. 3, when the swimmer floats on the water surface, the upper tube (30) is adjacent to an inner wall of the upper shell (50) and the lower shell (10) and opposed to the seal board (53) due to the weight of the upper tube (30) so that the swimmer can breathe in and out freely.

With reference to FIGS. 2 to 5, when the swimmer's face and mask are immersed, the water enters the lower shell (10) via the first, the second and the third vent (13, 15, 16) so that with the flotation device, the open end (31) pivots via the lugs (22) being mated with the holes (33) and adjacent to the seal board (53). When the swimmer and snorkel are completely immersed in the water, the water also enters the upper shell (50) via the orifice (51) so that the open end (31) is securely connected to the seal board (53) to prevent the water from entering the upper tube (30) to achieve a waterproof effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof device for a snorkel, comprising:

a lower shell having a lower pipe mounted on a lower end of the lower shell, and multiple vents respectively defined in a periphery of the lower shell, and a breather pipe sleeved over the lower pipe;

a ring securely received in the lower pipe;

an elastic collar with a first end configured to engage with a top end of the ring, and a second end;

an upper tube shaving a bottom end configured to engage with the second end of the elastic collar and pivotal relative to the ring and an open end defined in a top end of the upper tube; and an upper shell fastened with the lower shell and having at least one orifice defined in a top end thereof, wherein two first ears are respectively formed in two opposed top sides of the ring, two lugs are respectively formed on an outer wall of the first ears, two second ears are respectively formed in the bottom end of the upper tube and mated with the first ears, and two holes are respectively defined in the second ears and mated with the lugs.

2. The waterproof device for a snorkel as claimed in claim 1, wherein a chamber is formed in a side of the upper tube and a sponge is received in the chamber.

3. The waterproof device for a snorkel as claimed in claim 1, wherein a chamber is formed in a side of the upper tube and the chamber defines an air-filled space.

4. The waterproof device for a snorkel as claimed in claim 1, wherein a flange is formed on an upper end of the lower shell, and a rim is defined in a lower end of the upper shell and mated with the flange.

5. The waterproof device for a snorkel as claimed in claim 1, wherein a first circular groove is defined in an outer circumference of the ring and a second circular groove is defined in an outer circumference of the upper tube, an upper end of the elastic collar is mounted around the second circular groove and a lower end of the elastic collar is mounted around the first circular groove, whereby the elastic collar is securely connected to the ring and the upper tube.

6. The waterproof device for a snorkel as claimed in claim 5, wherein a seal board is securely connected to an inner wall of the upper shell and configured to mate with the open end.

7. A waterproof device for a snorkel, comprising:

a lower shell having a lower pipe mounted on a lower end of the lower shell, and multiple vents respectively defined in a periphery of the lower shell, and a breather pipe sleeved over the lower pipe;

a ring securely received in the lower pipe;

an elastic collar with a first end configured to engage with a top end of the ring, and a second end;

an upper tube having a bottom end configured to engage with the second end of the elastic collar and pivotal relative to the ring and an open end defined in a top end of the upper tube; and an upper shell fastened with the lower shell and having at least one orifice defined in a top end thereof, wherein a chamber is formed in a side of the upper tube and a sponge is received in the chamber.

8. The waterproof device for a snorkel as claimed in claim 7, wherein two first ears are respectively formed in two opposed top sides of the ring, two lugs are respectively formed on an outer wall of the first ears, two second ears are respectively formed in the bottom end of the upper tube and mated with the first ears, and two holes are respectively defined in the second ears and mated with the lugs.

9. The waterproof device for a snorkel as claimed in claim 7, wherein a flange is formed on an upper end of the lower shell, and a rim is defined in a lower end of the upper shell and mated with the flange.

10. The waterproof device for a snorkel as claimed in claim 7, wherein a first circular groove is defined in an outer circumference of the ring and a second circular groove is defined in an outer circumference of the upper tube, an upper end of the elastic collar is mounted around the second circular groove and a lower end of the elastic collar is mounted around the first circular groove, whereby the elastic collar is securely connected to the ring and the upper tube.

11. The waterproof device for a snorkel as claimed in claim 10, wherein a seal board is securely connected to an inner wall of the upper shell and configured to mate with the open end.

12. A waterproof device for a snorkel comprising:

a lower shell having a lower pipe mounted on a lower end of the lower shell, and multiple vents respectively defined in a periphery of the lower shell, and a breather pipe sleeved over the lower pipe;

a ring securely received in the lower pipe;

an elastic collar with a first end configured to engage with a top end of the ring, and a second end;

an upper tube having a bottom end configured to engage with the second end of the elastic collar and pivotal relative to the ring and an open end defined in a top end of the upper tube; and an upper shell fastened with the lower shell and having at least one orifice defined in a top end thereof, wherein a first circular groove is defined in an outer circumference of the ring and a second circular groove is defined in an outer circumference of the upper tube, an upper end of the elastic collar is mounted around the second circular groove and a lower end of the elastic collar is mounted around the first circular groove, whereby the elastic collar is securely connected to the ring and the upper tube.

13. The waterproof device for a snorkel as claimed in claim 12, wherein a chamber is formed in a side of the upper tube and a sponge is received in the chamber.

14. The waterproof device for a snorkel as claimed in claim 12, wherein two first ears are respectively formed in two opposed top sides of the ring, two lugs are respectively formed on an outer wall of the first ears, two second ears are respectively formed in the bottom end of the upper tube and mated with the first ears, and two holes are respectively defined in the second ears and mated with the lugs.

15. The waterproof device for a snorkel as claimed in claim 12, wherein a flange is formed on an upper end of the lower shell, and a rim is defined in a lower end of the upper shell and mated with the flange.

16. The waterproof device for a snorkel as claimed in claim 15, wherein a seal board is securely connected to an inner wall of the upper shell and configured to mate with the open end.

* * * * *